US008475222B2

(12) United States Patent
Ishizaka et al.

(10) Patent No.: US 8,475,222 B2
(45) Date of Patent: Jul. 2, 2013

(54) OUTBOARD ENGINE

(75) Inventors: Kazuhiro Ishizaka, Wako (JP); Masanori Tsubouchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 162 days.

(21) Appl. No.: 13/114,810

(22) Filed: May 24, 2011

(65) Prior Publication Data

US 2011/0294379 A1 Dec. 1, 2011

(30) Foreign Application Priority Data

May 25, 2010 (JP) ..... 2010-119545

(51) Int. Cl.
*B63H 21/14* (2006.01)
*B63H 21/00* (2006.01)
*B63H 21/34* (2006.01)

(52) U.S. Cl.
USPC ..... 440/88 C; 440/89 A; 440/89 G

(58) Field of Classification Search
USPC ..... 440/88 HE, 88 J, 89 A, 89 B, 89 C, 440/89 G
See application file for complete search history.

(56) References Cited

U.S. PATENT DOCUMENTS 1,478,948 A * 12/1923 Gara ..... 60/310
4,507,092 A * 3/1985 Hall et al. ..... 440/89 R
5,937,801 A * 8/1999 Davis ..... 123/41.33

FOREIGN PATENT DOCUMENTS

JP 2007-283857 A 11/2007

* cited by examiner

*Primary Examiner* — Stephen Avila
(74) *Attorney, Agent, or Firm* — Arent Fox LLP

(57) ABSTRACT

An outboard engine is disclosed that includes an idling chamber that communicates with a guiding outlet of a first exhaust path and that is open to the atmosphere. The idling chamber includes a cooling water communicating path that communicates with a cooling water supplying path, and a pressure adjusting valve that opens the cooling water communicating path when the value of the water pressure in the cooling water supplying path reaches a threshold value. When the value of the water pressure in the cooling water supplying path reaches the threshold value, the pressure adjusting valve opens and a portion of cooling water is guided to the idling chamber through the cooling water communicating path.

5 Claims, 8 Drawing Sheets

101
96
103
62b
52
62
98
102
97
93
104
96a
96
82
62a
51
51a
81

OUTBOARD ENGINE

FIELD OF THE INVENTION

The present invention relates to an outboard engine that includes a cooling water path to suck in seawater or freshwater as cooling water and an exhaust path to discharge exhaust gas of the engine into the water.

BACKGROUND OF THE INVENTION

Usually, an outboard engine is adapted to: be fitted to a hull; have an exhaust outlet of an exhaust path (exhaust system) to discharge exhaust gas of its engine, submerged in the water that is the exterior of the hull; and discharge the exhaust gas in the exhaust path from the exhaust outlet into the water by rotating a propeller. An exhaust noise of the exhaust gas can be suppressed by discharging the exhaust gas into the water.

During the rotation of the engine in idling of the outboard engine (at the no-load minimum engine speed), the propeller for propulsion is maintained in its stoppage state and the exhaust pressure of the exhaust gas is low. Therefore, it is difficult to externally discharge the exhaust gas from the exhaust outlet through the seawater.

Therefore, an idling exhaust path is provided for the exhaust path at a halfway point of the exhaust path and the idling exhaust path is open to the atmosphere. Thereby, the exhaust gas produced during the rotation in idling can externally be discharged from the idling exhaust path. In this case, to suppress the exhaust noise of the exhaust gas discharged from the idling exhaust path, the idling exhaust path is provided with an idling chamber.

As to the outboard engine, by providing the idling exhaust path for the exhaust path at the halfway point of the exhaust path, occurrence of any negative pressure can be prevented in the exhaust path (exhaust system), for example, when the engine is started up or when the exhaust pulsates. An outboard engine is known as is disclosed in, for example, Japanese Patent Application Laid-Open Publication No. 2007-283857, that can suppress the sucking up of seawater or freshwater from the exhaust path due to the negative pressure by preventing the occurrence of the negative pressure in the exhaust path as above.

However, the outboard engine disclosed in the above '857 publication also externally discharges the exhaust gas from the idling exhaust path when, for example, the engine drives with its high speed rotations. When the engine rotates at a high speed, the amount of the exhaust gas discharged is also increased. Therefore, the idling chamber provided for the idling exhaust path is overheated by the exhaust gas and, from this viewpoint, room for improvement of the outboard engine is still left.

SUMMARY OF THE INVENTION

The object of the present invention is to provide an outboard engine that is able to discharge its exhaust gas when its engine rotates in idling, that is able to suppress occurrence of any negative pressure in an exhaust path (exhaust system), and that is able to suppress overheating of an idling chamber.

According to an aspect of the present invention, an outboard engine is provided that sucks in cooling water using a cooling water path by rotating a water pump using an engine, and that externally discharges exhaust gas of the engine using an exhaust path, including an idling chamber that communicates with the exhaust path at a halfway point of the exhaust path, the idling chamber being open to an atmosphere; a cooling water communicating path that causes the idling chamber and the cooling water path to communicate with each other; and a pressure adjusting valve that is provided for the cooling water communicating path, the pressure adjusting valve opening the cooling water communicating path when a value of a water pressure in the cooling water path reaches a threshold value, wherein a portion of the cooling water is guided to the idling chamber through the cooling water communicating path by opening the pressure adjusting valve when the value of the water pressure in the cooling water path reaches the threshold value.

As above, according to the present invention, the idling chamber is caused to communicate with the exhaust path at a halfway position of the exhaust path to make the idling chamber open to the atmosphere. Therefore, the exhaust gas produced during rotations in idling (at a no-load minimum engine speed) can suitably be externally (to the atmosphere) discharged from the idling chamber. In addition, by making the exhaust path open to the atmosphere at the halfway point thereof through the idling chamber, occurrence can be suppressed of any negative pressure in the exhaust path (exhaust system) when the engine is started up or when the exhaust pulsates.

In addition, the idling chamber and the cooling water path are caused to communicate with each other by the cooling water communicating path, the cooling water communicating path is provided with the pressure adjusting valve, and the pressure adjusting valve is adapted to open when the value of the water pressure in the cooling water path reaches the threshold value to guide a portion of the cooling water to the idling chamber through the cooling water communicating path. Therefore, the idling chamber can be cooled by the portion of the cooling water and, thereby, overheating of the idling chamber can be suppressed.

Preferably, the pressure adjusting valve is opened by the water pressure of the cooling water when the engine rotates at a high speed. Therefore, when a relatively large amount of exhaust gas flows in the idling chamber, the pressure adjusting valve is opened and the portion of the cooling water is guided to the idling chamber. Thereby, overheating can be suppressed of the idling chamber by the relatively large amount of exhaust gas.

In addition, by maintaining the pressure adjusting valve to be closed when the engine rotates at a low speed (low speed rotations), the portion of the cooling water can be caused not to be guided to the idling chamber when the hull is moored or during trolling to cause the hull to patrol at a low speed. Thereby, the cooling water is prevented from being discharged into the atmosphere during the mooring or the trolling. Thereby, merchantability can be secured.

Preferably, the idling chamber is formed into a labyrinth structure that separates the cooling water that is guided to the idling chamber from the exhaust gas. Therefore, discharge is enabled of only the exhaust gas into the atmosphere without discharging the cooling water into the atmosphere. Thereby, the quality of merchandize can be secured.

Preferably, the idling chamber includes an upper chamber unit, a lower chamber unit, and a sealing material that is held being sandwiched by the upper chamber unit and the lower chamber unit and the labyrinth structure is configured by upper partition walls provided for the upper chamber unit, lower partition walls provided for the lower chamber unit, and openings formed in the sealing material. Therefore, the labyrinth structure can be configured using the constituent members of the idling chamber and, therefore, dedicated parts for the labyrinth structure can be unnecessary. Thereby, the labyrinth structure can be formed without increasing the number of parts of the idling chamber.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
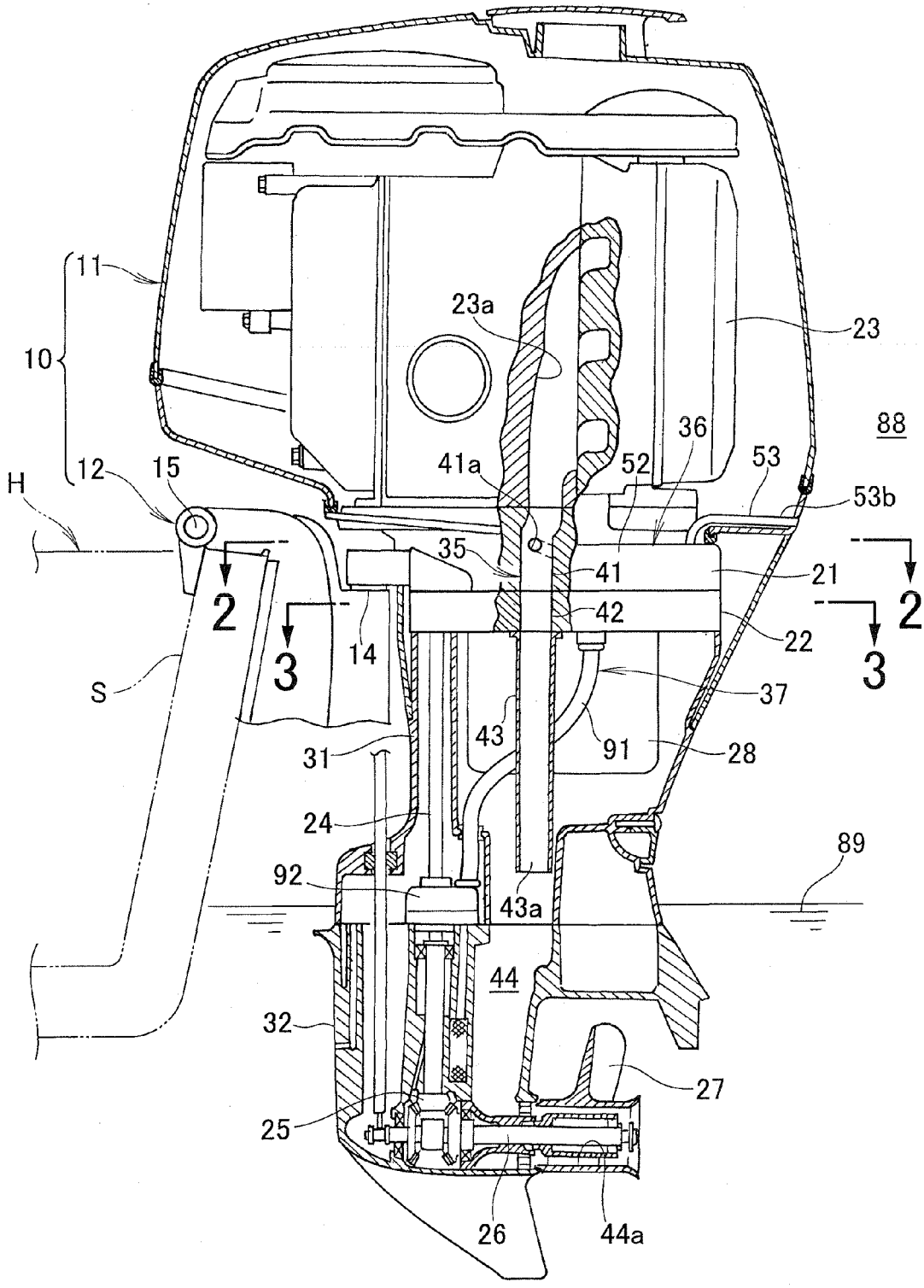
FIG. 1 is a cross-sectional view of an outboard engine according to an embodiment of the present invention.

As shown in FIG. 1, an outboard engine 10 includes an outboard engine main body 11 and a fitting means 12 that is provided for the outboard engine main body 11 and that is attachable and detachable to/from a hull H (specifically, a stern S). The fitting means 12 includes a swivel shaft 14 that can wag the outboard engine main body 11 to the right and left (in the horizontal direction) and a tilt shaft 15 that can wag the outboard engine main body 11 to upward and downward.

The outboard engine main body 11 includes a mount case 21 that is provided for the fitting means 12, an oil case 22 that is provided for a lower portion of the mount case 21, an engine 23 mounted on an upper portion of the mount case 21, a driving shaft 24 that is joined with a crank shaft not depicted of the engine 23 being coaxially aligned with the crank shaft, a gear mechanism 25 to which rotations of the engine 23 (the crank shaft) is transmitted through the driving shaft 24, and a propeller 27 to which rotations of the gear mechanism 25 is transmitted through a propeller shaft 26.

The mount case 21 includes an upper half of an idling exhaust means 36 described later. The oil case 22 includes an oil pan 28 that stocks lubricating oil for the engine 23, and a lower half of the idling exhaust means 36. The driving shaft 24 is covered with an extension case 31 that is provided under the mount case 21. The gear mechanism 25 and the propeller shaft 26 are covered with a gear case 32 that is provided under the extension case 31.

By the outboard engine 10, by driving the engine 23: rotations of the engine 23 is transmitted to the propeller 27 through the driving shaft 24, the gear mechanism 25, and the propeller shaft 26; the propeller 27 is rotated; and, thereby, the hull H is propelled.

The outboard engine main body 11 includes an exhaust means 35 that communicates with an exhaust manifold 23*a* of the engine 23, the idling exhaust means 36 that communicates with the exhaust means 35, and a cooling water supplying means 37 that guides seawater or freshwater as cooling water to the idling exhaust means 36 and the engine 23.

The exhaust means 35 includes a first exhaust path (exhaust path) 41 that communicates with the exhaust manifold 23*a*, a second exhaust path (exhaust path) 42 that communicates with the first exhaust path 41, an exhaust pipe (exhaust path) 43 that communicates with the second exhaust path 42, and an exhaust expanding chamber 44 that communicates with an exhaust outlet 43*a* of the exhaust pipe 43.

The first exhaust path 41 is formed on the mount case 21. The second exhaust path 42 is formed on the oil case 22. The exhaust pipe 43 extends downward from the second exhaust path 42 in the extension case 31. The exhaust expanding chamber 44 is formed by the inner space of the extension case 31 and the inner space of the gear case 32.

By the exhaust means 35, the exhaust gas guided from the exhaust manifold 23*a* is discharged from the exhaust outlet 43*a* of the exhaust pipe 43 to the exhaust expanding chamber 44. In this state, by rotating the propeller 27, seawater or freshwater behind the propeller 27 is pushed backward. Thereby, the exhaust gas discharged to the exhaust expanding chamber 44 is guided toward an exhaust outlet 44*a* of the exhaust expanding chamber 44 through the exhaust expanding chamber 44, and is discharged from the exhaust outlet 44*a* into water (exterior) 89.

Figure 2:
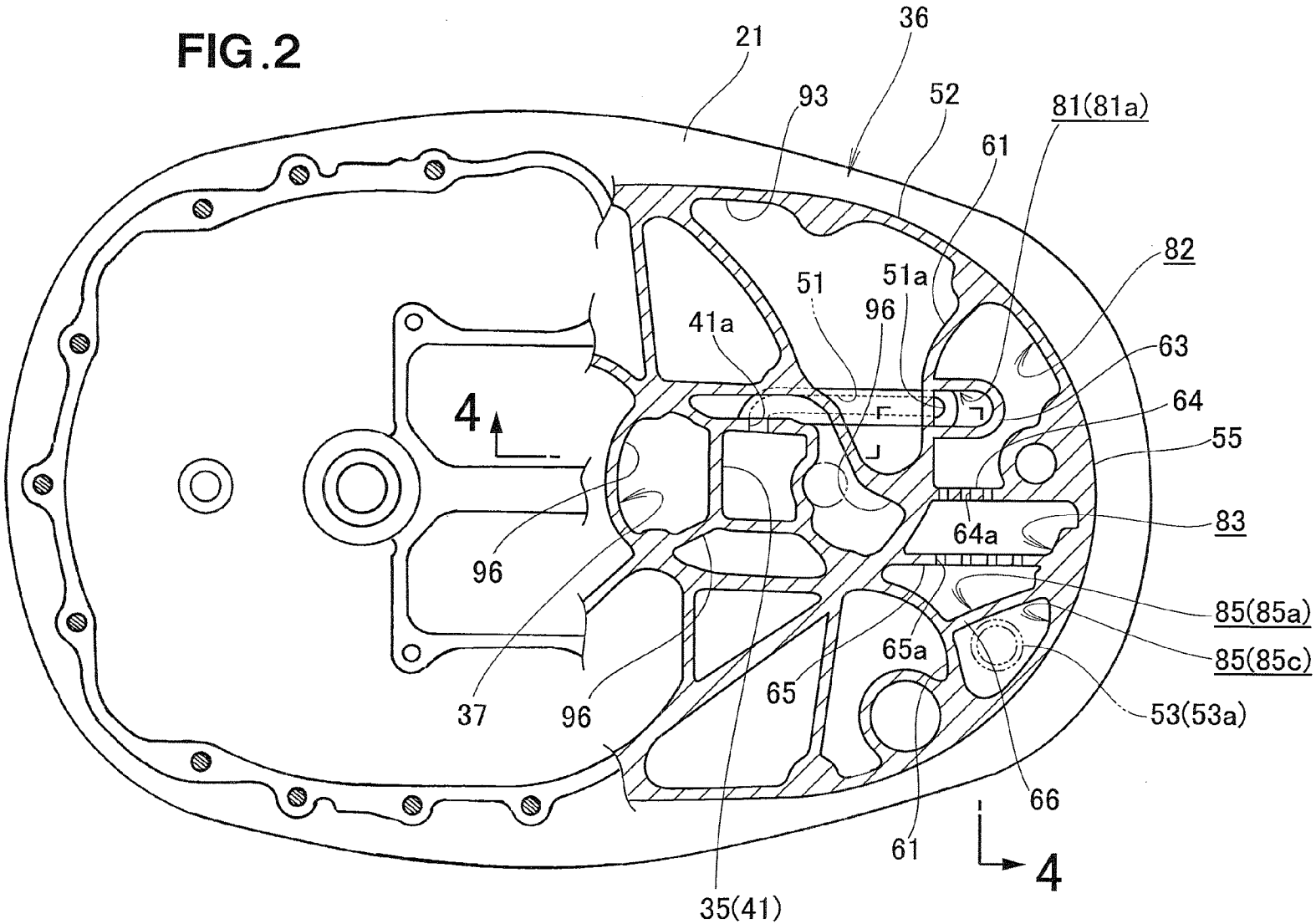
FIG. 2 is a cross-sectional view taken along line 2-2 of FIG. 1.
Figure 3:
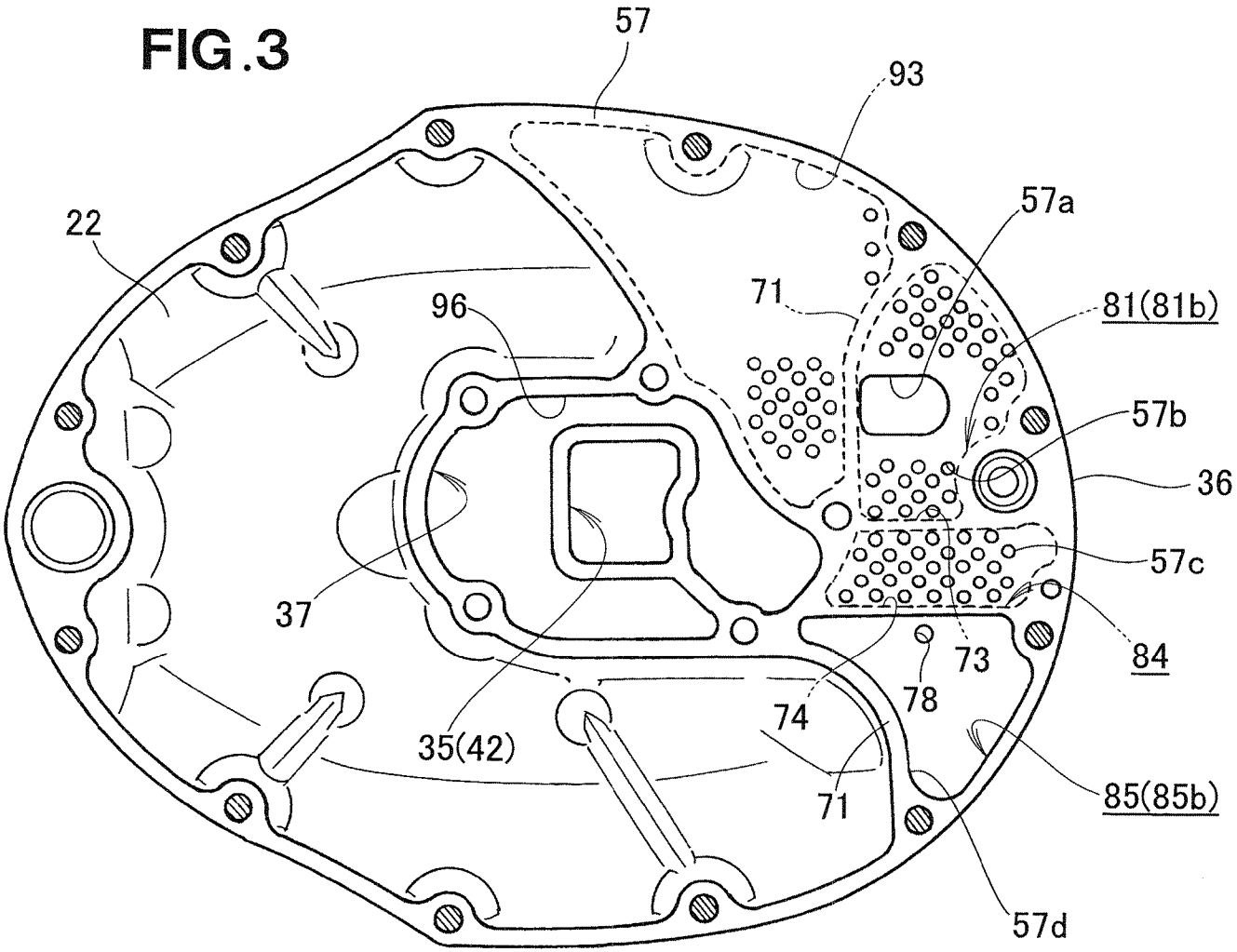
FIG. 3 is a cross-sectional view taken along line 3-3 of FIG. 1.
Figure 4:
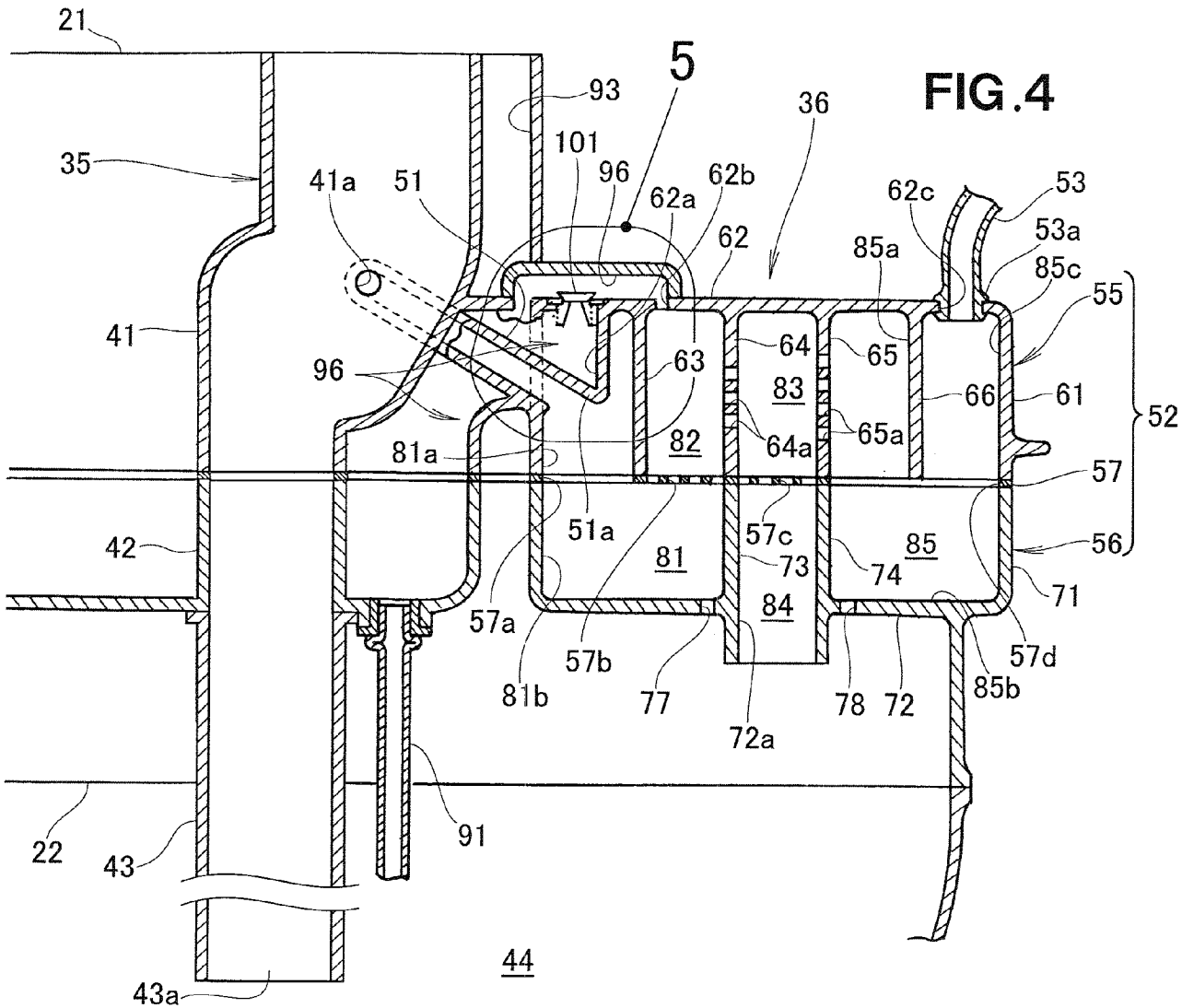
FIG. 4 is a cross-sectional view taken along line 4-4 of FIG. 2.

As depicted in FIGS. 2 to 4, the idling exhaust means 36 communicates with the first exhaust path 41 of the exhaust means 35. The idling exhaust means 36 includes an idling exhaust communicating path 51 that communicates with the first exhaust path 41 at a halfway point of the first exhaust path 41, an idling chamber 52 that communicates with the idling exhaust communicating path 51, and an open-to-atmosphere path 53 that communicates with the idling chamber 52 and that is open to the atmosphere.

The idling exhaust communicating path 51 is integrally formed to the mount case 21 and extends descending from a guiding outlet 41*a* of the first exhaust path 41 at a halfway point thereof to the idling chamber 52.

The idling chamber 52 includes an upper chamber unit 55 that is integrally formed to the mount case 21, a lower chamber unit 56 that is integrally formed to the oil case 22, and a metal gasket (sealing material) 57 that intervenes between the upper and the lower chamber units 55 and 56.

The upper chamber unit 55 includes an upper wall unit 61, a top unit 62, and a first to a fourth upper partition walls 63 to 66. A plurality of first slits 64*a* are formed in the second upper partition wall 64 and a plurality of second slits 65*a* are formed in the third upper partition wall 65.

A recess 62*a* is formed on a front portion of the top unit 62. A rear end 51*a* of the idling exhaust communicating path 51 is formed continuously and adjacent to the recess 62*a*. An opening 62*b* for cooling water is formed in a front portion of the top unit 62. A second partition chamber 82 of the idling chamber 52 communicates with a cooling water communicating path 96 (idling communicating path 97 (see FIG. 5)) through the opening 62*b*.

The open-to-atmosphere path 53 is provided in a rear portion of the top unit 62. By providing the open-to-atmosphere path 53 in the rear portion of the top unit 62, an exhaust outlet 53*b* (FIG. 1) of the open-to-atmosphere path 53 is caused to communicate with a fifth partition chamber 85 of the idling chamber 52.

The lower chamber unit 56 includes a lower wall unit 71, a bottom unit 72, and a first and a second lower partition walls (lower partition walls) 73 and 74. An upper end of the first lower partition wall 73 is butted against a lower end of the second upper partition wall 64 through the metal gasket 57.

An upper end of the second lower partition wall 74 is butted against a lower end of the third upper partition wall 65 through the metal gasket 57.

An opening 72*a* is formed in a region between the first and the second lower partition walls 73 and 74 in the bottom unit 72 of the lower chamber unit 56. The region between the first and the second lower partition walls 73 and 74 is opened as the opening 72*a* and, thereby, a fourth partition chamber 84 of the idling chamber 52 is caused to communicate with the exhaust expanding chamber 44 (see also FIG. 1). In addition, a first drain hole 77 is formed in a region that corresponds to a first partition chamber 81 in the bottom unit 72 and a second drain hole 78 is formed in a region that corresponds to a fifth partition chamber 85 in the bottom unit 72.

The upper and the lower chamber units 55 and 56 are overlapped with each other holding and sandwiching the metal gasket 57 therebetween and, thereby, the inner space of the idling chamber 52 is partitioned into the first to the fifth partition chambers 81 to 85 by the first to the fourth upper partition walls 63 to 66, the first and the second lower partition walls 73 and 74, and the metal gasket 57.

The metal gasket 57 is held (intervenes) being sandwiched between the mount case 21 and the oil case 22 and is a member that hermetically seals a gap between the mount case 21 and the oil case 22. The metal gasket 57 is formed by punching a sheet of a metal such as copper, stainless steel, or aluminum. The metal gasket 57 includes a first opening (opening hole) 57*a*, a plurality of first punched holes (opening holes) 57*b*, a plurality of second punched holes (opening holes) 57*c*, and a second opening (opening hole) 57*d*.

The first opening 57*a* is formed between an upper and a lower partition chambers 81*a* and 81*b* of the first partition chamber 81 and, thereby, the upper and the lower partition chambers 81*a* and 81*b* communicate with each other. The first punched holes 57*b* are holes each having a small diameter, that cause the first and the second partition chambers 81 and 82 to communicate with each other by being formed between the first and the second partition chambers 81 and 82. The second punched holes 57*c* are holes each having a small diameter, that cause the third and the fourth partition chambers 83 and 84 to communicate with each other by being formed between the third and the fourth partition chambers 83 and 84. The second opening 57*d* is formed between a front upper and a lower partition chambers 85*a* and 85*b* of the fifth partition chamber 85, is also formed between a rear upper and a lower partition chambers 85*c* and 85*b* of the fifth partition chamber 85 and, thereby, causes the front upper, the lower, and the rear upper partition chambers 85*a*, 85*b*, and 85*c* of the fifth partition chamber 85 to communicate with each other.

In this manner: the first partition chamber 81 communicates with the second partition chamber 82 through the first punched holes 57*b*; the second partition chamber 82 communicates with the third partition chamber 83 through the first slits 64*a*; the third partition chamber 83 communicates with the fourth partition chamber 84 through the second punched holes 57*c*; and the third partition chamber 83 communicates with the fifth partition chamber 85 through the second slits 65*a*.

As above, the idling chamber 52 is formed into the labyrinth structure by dividing the inner space thereof into and isolating from each other the first to the fifth partition chambers 81 to 85 by the first to the fourth upper partition walls 63 to 66, the first and the second lower partition walls 73 and 74, and the metal gasket 57.

Therefore, the labyrinth structure can be configured using the constituent members of the idling chamber 52 (the upper and the lower chamber units 55 and 56, and the metal gasket 57) and, therefore, any dedicated part for the labyrinth structure is unnecessary. Thereby, the labyrinth structure can be provided without increasing the number of parts of the idling chamber 52.

The open-to-atmosphere path 53 is provided for a rear portion of the top unit 62 of the idling chamber 52. In the open-to-atmosphere path 53, a base end 53*a* is fitted with an opening 62*c* that is formed for a rear portion of the top unit 62 and the exhaust outlet 53*b* (FIG. 1) is open to the atmosphere. Therefore, the guiding outlet 41*a* of the first exhaust path 41 communicates with the atmosphere through the idling exhaust communicating path 51, the idling chamber 52, and the open-to-atmosphere path 53.

By the idling exhaust means 36, the exhaust gas flowing in the first exhaust path 41 is guided from the guiding outlet 41*a* to the first partition chamber 81 of the idling chamber 52 through the idling exhaust communicating path 51. The exhaust gas guided to the first partition chamber 81 is guided to the second partition chamber 82 through the plurality of first punched holes 57*b* and to the third partition chamber 83 through the plurality of first slits 64*a*.

For example, when the engine 23 depicted in FIG. 1 rotates in idling (at the no-load minimum engine speed), the propeller 27 is stopped and, therefore, the exhaust gas can not be discharged into the water (exterior) 89 from the exhaust outlet 44*a* of the exhaust expanding chamber 44. Therefore, flowing is suppressed of the exhaust gas guided to the third partition chamber 83 depicted in FIG. 4 toward the exhaust expanding chamber 44 through the fourth partition chamber 84 and the exhaust gas is guided to the fifth partition chamber 85 through the plurality of second slits 65*a*.

The exhaust gas in the exhaust expanding chamber 44 is guided to the fourth partition chamber 84 through the opening 72*a* and is guided to the third partition chamber 83 through the plurality of second punched holes 57*c*.

The exhaust gas guided to the third partition chamber 83 is guided to the fifth partition chamber 85 through the plurality of second slits 65*a*. The exhaust gas guided to the fifth partition chamber 85 is guided to the open-to-atmosphere path 53 through the front upper, the lower, and the rear upper partition chambers 85*a*, 85*b*, and 85*c* of the fifth partition chamber 85, and is discharged from the exhaust outlet 53*b* of the open-to-atmosphere path 53 to the atmosphere 88 (see FIG. 1).

On the other hand, when the engine 23 depicted in FIG. 1 rotates at a high speed and the hull H slides, the exhaust gas in the exhaust expanding chamber 44 is discharged from the side of the propeller 27 into the sea 89. Therefore, the exhaust gas guided to the third partition chamber 83 depicted in FIG. 4 is guided to the fifth partition chamber 85 through the plurality of second slits 65*a* and is guided to the fourth partition chamber 84 through the plurality of second punched holes 57*c*. The exhaust gas guided to the fourth partition chamber 84 is discharged from the exhaust outlet 44*a* on the side of the propeller 27 (FIG. 1) into the sea 89 through the exhaust expanding chamber 44.

As depicted in FIGS. 1 and 4, the cooling water supplying means 37 guides seawater or freshwater (hereinafter, simply "seawater") as cooling water to the idling exhaust means 36 and also guides seawater as cooling water to a water jacket of the engine 23.

The cooling water supplying means 37 includes a cooling water supplying path (cooling water path) 91 that communicates with an inlet port of the water jacket, a water pump 92 that sucks up seawater as cooling water to the cooling water supplying path 91, and a cooling water discharging path 93 (see also FIG. 2) that communicates with an outlet port of the water jacket.

The cooling water supplying means 37 includes a cooling water communicating path 96 that causes the cooling water supplying path 91 to communicate with the idling chamber 52 (first partition chamber 81), and a relief valve (pressure adjusting valve) 101 that is provided for the cooling water communicating path 96.

Figure 5:
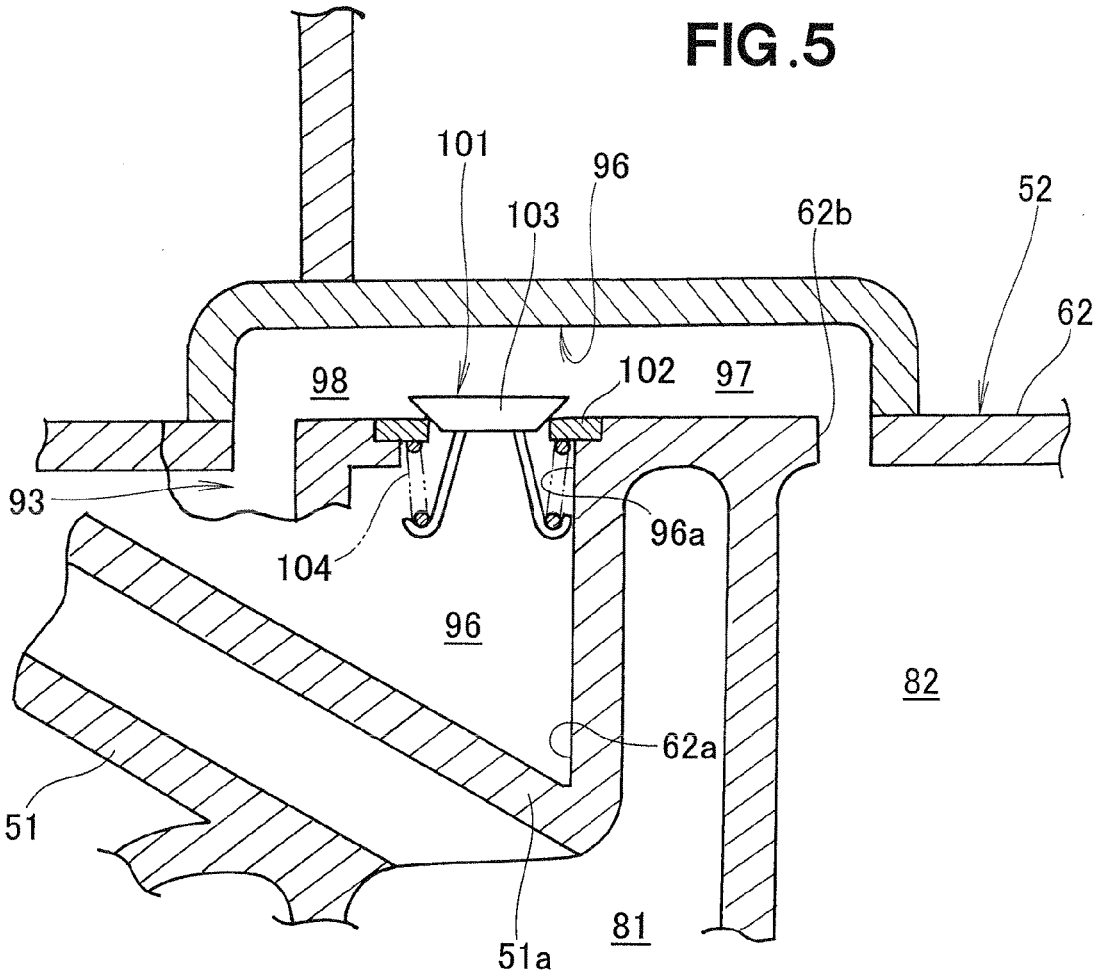
FIG. 5 is an enlarged cross-sectional view of an area 5 of FIG. 4.

As depicted in FIG. 5, the cooling water communicating path 96 branches downstream the relief valve 101 into the idling communicating path 97 that communicates with the idling chamber 52 (second partition chamber 82) and a water-discharge communicating path 98 that communicates with the cooling water discharging path 93 (see also FIG. 4).

The cross-sectional area ratio of a path cross-sectional area S1 of the idling communicating path 97 and a path cross-sectional area S2 of the water-discharge communicating path 98 is adjusted such that the amount of cooling water necessary for cooling the idling chamber 52 can suitably be secured.

As depicted in FIG. 1, the water pump 92 is connected to the driving shaft 24 through a gear means and the speed of rotation of the water pump 92 varies in proportion to the speed of rotation of the driving shaft 24 (that is, the speed of rotation of the engine 23). Therefore, when the speed of rotation of the engine 23 is increased, the speed of rotation of the water pump 92 is increased and the water pressure in the cooling water supplying path 91 and the cooling water communicating path 96 (FIG. 5) is increased.

As depicted in FIG. 5, the relief valve 101 includes a valve seat 102 that is provided for an opening 96*a* of the cooling water communicating path 96, a valve main body 103 that can open and close the valve seat 102, and a compression spring 104 that presses the valve main body 103 to the valve seat 102.

By the relief valve 101, the valve main body 103 abuts against the valve seat 102 due to a spring force of the compression spring 104 when the value of the water pressure in the cooling water communicating path 96 or the cooling water supplying path 91 (FIG. 1) does not reach a threshold value Pt. The valve main body 103 abuts against the valve seat 102 and, thereby, the cooling water communicating path 96 is maintained in its closed state.

On the other hand, when the value of the water pressure in the cooling water supplying path 91 reaches the threshold value Pt, the compression spring 104 is compressed by the cooling water and the valve main body 103 leaves the valve seat 102. The valve main body 103 leaves the valve seat 102 and, thereby, the cooling water communicating path 96 is maintained in its open state.

The threshold value Pt is set in advance as an example such that the value of the water pressure of the cooling water reaches the threshold value Pt when the speed of the rotation of the engine 23 depicted in FIG. 1 reaches a high speed of 5,000 rpm. When the speed of the rotation of the engine 23 reaches the high speed of 5,000 rpm, the speed of the rotation of the water pump 92 also reaches a high speed and, therefore, the amount of seawater sucked up by the water pump 92 is increased. Thereby, the value of the water pressure in the cooling water supplying path 91 is increased and reaches the threshold value Pt.

By the cooling water supplying means 37, when the value of the water pressure in the cooling water supplying path 91 reaches the threshold value Pt, the relief valve 101 is opened. Due to this opening of the relief valve 101, a portion of the cooling water is guided to the idling chamber 52 (second partition chamber 82) through the idling communicating path 97.

In the above, it can be considered as an example that, when the relief valve 101 is opened, the amount of the cooling water flowing through the relief valve 101 exceeds the amount of cooling water that suitably cools the idling chamber 52.

Therefore, the ratio of the path cross-sectional areas S1 and S2 respectively of the idling communicating path 97 and the water-discharge communicating path 98 is adjusted as above such that the amount of cooling water supplied to the idling chamber 52 can suitably be secured. Thereby, the amount of cooling water that is necessary for cooling the idling chamber 52 is guided to the idling communicating path 97 and the rest of the cooling water is guided to the cooling water discharging path 93 through the water-discharge communicating path 98.

In this manner, the idling chamber 52 can suitably be cooled by adjusting the amount of the cooling water.

An example where the exhaust gas is discharged from the idling chamber 52 when the engine 23 is rotated in idling will be described with reference to FIGS. 6A and 6B.

Figure 6A:
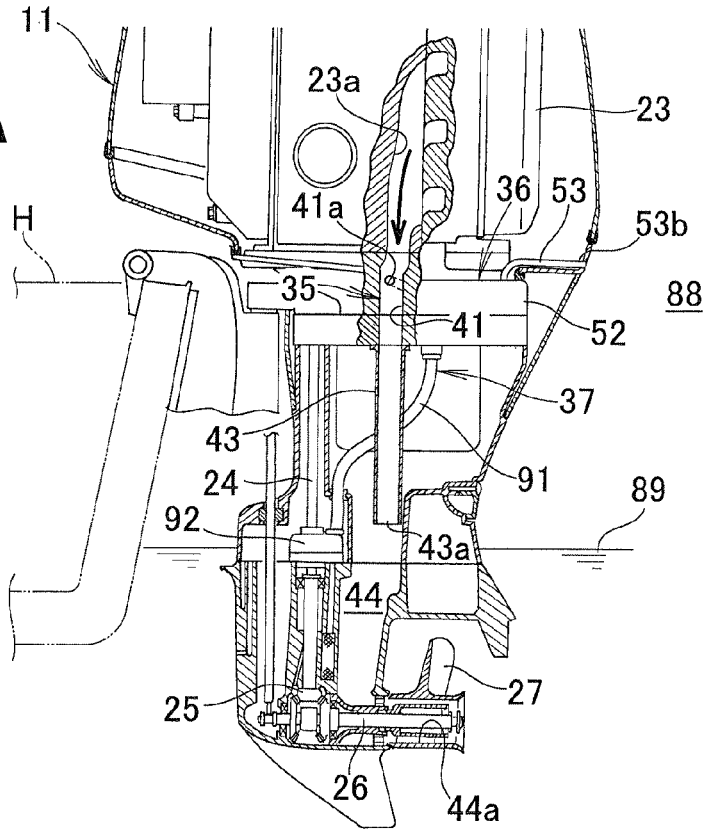
FIGS. 6A and 6B are diagrams of an example of a flow by which exhaust gas is discharged from an idling chamber when an engine is rotated in idling.

As depicted in FIG. 6A, the engine 23 is rotated in idling when the propeller 27 of the outboard engine main body 11 is stopped. Because the propeller 27 is stopped, the exhaust gas in the exhaust expanding chamber 44 is not discharged from the exhaust outlet 44*a* into the seawater 89.

In addition, the speed of rotation of the engine 23 can be suppressed at a speed lower than 5,000 rpm by rotating the engine 23 in idling. The speed of rotation of the water pump 92 is also suppressed at a low speed by suppressing the speed of rotation of the engine 23 at a low speed. Therefore, the amount of seawater sucked up by the water pump 92 is suppressed.

The value of the water pressure in the cooling water communicating path 96 (FIG. 5) of the cooling water supplying path 91 can be suppressed at a value lower than the threshold value Pt by suppressing the amount of seawater sucked up. Therefore, a relief valve 101 is maintained in its closed state. Thereby, all the cooling water (seawater) that is sucked up by the water pump 92 can be guided to the water jacket of the engine 23 through the cooling water supplying path 91 and the cooling water communicating path 96 (see FIG. 6B).

In this state, the exhaust gas is guided as indicated by an arrow from the exhaust manifold 23*a* to the first exhaust path 41.

In this case, because the propeller 27 is stopped, the exhaust gas remains in the exhaust expanding chamber 44 and, therefore, the inner pressure of the exhaust expanding chamber 44 is increased.

Figure 6B:
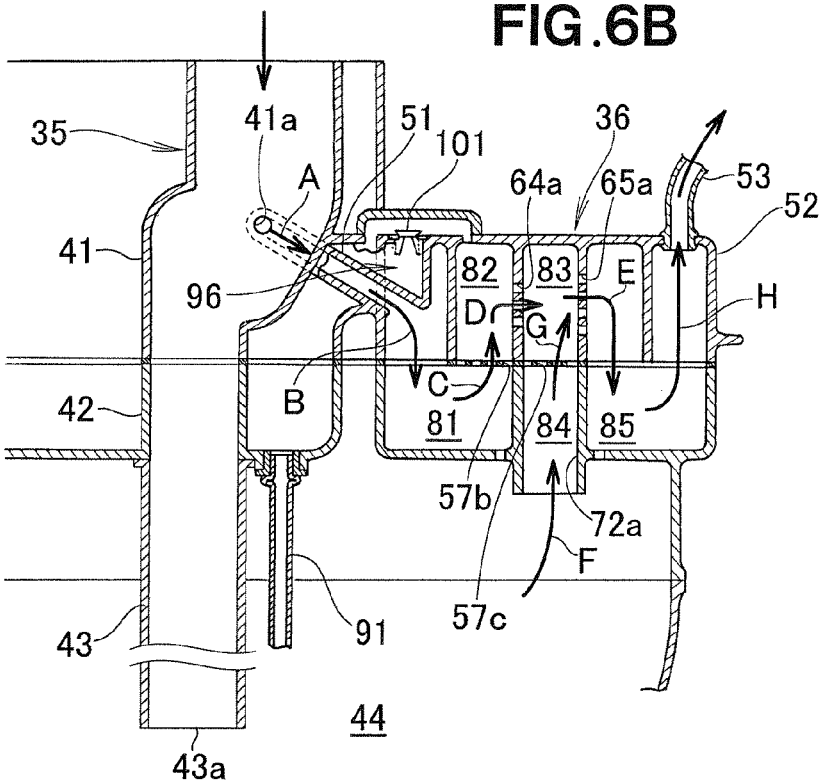

As depicted in FIG. 6B, the exhaust gas guided to the first exhaust path 41 is guided as indicated by an arrow A from the guiding outlet 41*a* of the first exhaust path 41 to the idling exhaust communicating path 51. The exhaust gas guided is guided as indicated by an arrow B to the first partition chamber 81 of the idling chamber 52 through the idling exhaust communicating path 51.

The exhaust gas guided to the first partition chamber 81 is guided as indicated by an arrow C to the second partition chamber 82 through the plurality of first punched holes 57*b*. The exhaust gas guided to the second partition chamber 82 is guided as indicated by an arrow D to the third partition chamber 83 through the plurality of first slits 64*a*. The exhaust gas guided to the third partition chamber 83 is guided as indicated by an arrow E to the fifth partition chamber 85 through the plurality of second slits 65*a*.

On the other hand, the exhaust gas in the exhaust expanding chamber 44 is guided as indicated by an arrow F to the fourth partition chamber 84 through the opening 72*a*. The exhaust gas guided to the fourth partition chamber 84 is guided as indicated by an arrow G to the third partition chamber 83 through the plurality of second punched holes 57*c*.

The exhaust gas guided to the third partition chamber 83 is guided as indicated by an arrow E to the fifth partition chamber 85 through the plurality of second slits 65*a*. The exhaust gas guided to the fifth partition chamber 85 is guided as indicated by an arrow H to the open-to-atmosphere path 53 through the fifth partition chamber 85. The exhaust gas guided to the open-to-atmosphere path 53 is discharged from the exhaust outlet 53*b* (FIG. 6A) of the open-to-atmosphere path 53 to the exterior (atmosphere) 88 (FIG. 6A).

As above, the idling chamber 52 is caused to communicate with the first exhaust path 41 at the halfway point of the first exhaust path 41 (the guiding outlet 41*a*) and, thereby, the idling chamber 52 is made open to the exterior (atmosphere) 88. Thereby, when the engine 23 is rotated in idling with the propeller 27 being stopped, the exhaust gas of the engine 23 can suitably be discharged from the open-to-atmosphere path 53 to the exterior (atmosphere) 88 through the idling chamber 52.

The first exhaust path 41 is caused to be open to the exterior (atmosphere) 88 at the halfway point of the first exhaust path 41 (the guiding outlet 41*a*) through the idling chamber 52 and the open-to-atmosphere path 53. Thereby, occurrence of any negative pressure can be suppressed in the exhaust means 35 (exhaust system), for example, when the engine 23 is started up or when the exhaust pulsates.

In addition, when the engine 23 is rotated in idling, the amount of the exhaust gas discharged that is guided from the exhaust manifold 23*a* to the first exhaust path 41 is suppressed to a relatively small amount. Therefore, even when the exhaust gas is guided to the idling chamber 52, the idling chamber 52 may not be overheated by the exhaust gas.

When the engine 23 is rotated at a low speed, the relief valve 101 is maintained in its closed state. By maintaining the relief valve 101 in its closed state, the portion of the cooling water can be caused not to be guided to the idling chamber 52 when the hull H is moored or during trolling to cause the hull H to patrol at a low speed. Thereby, discharge of the cooling water to the exterior (atmosphere) 88 can be prevented when the hull H is moored or during the trolling and, therefore, the performance of the merchandize can be secured.

An example where the idling chamber 52 is cooled when the engine 23 is rotated at a high speed will be described with reference to FIGS. 7A, 7B, 8A, and 8B.

Figure 7A:
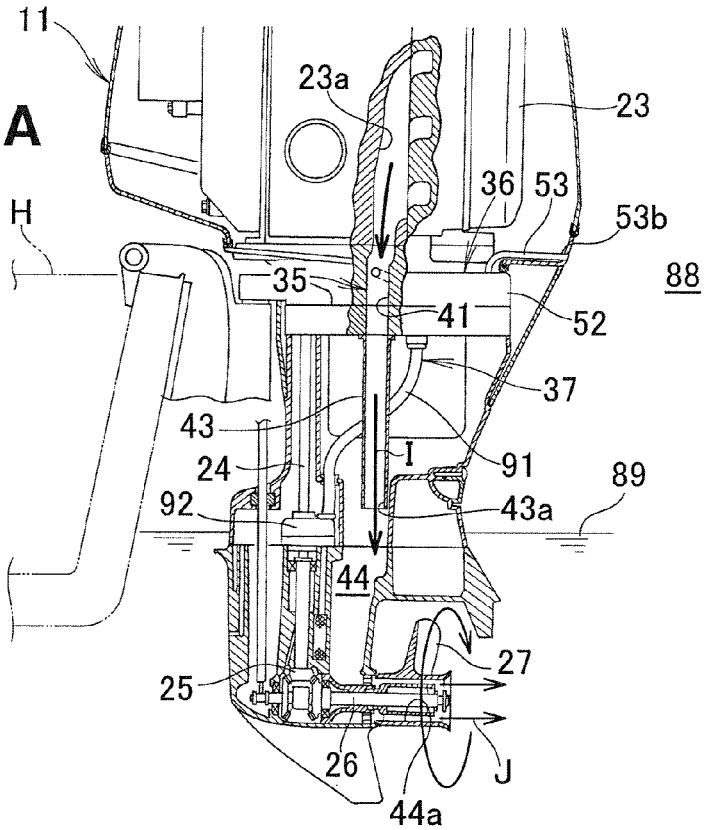
FIGS. 7A and 7B are diagrams of an example of a flow by which the exhaust gas is discharged from the idling chamber when the engine is rotated at a high speed.

As depicted in FIG. 7A, by rotating the engine 23 at a high speed such that the speed reaches 5,000 rpm, the speed of the rotation of the water pump 92 also becomes a high speed and, therefore, the amount of the seawater sucked up by the water pump 92 is increased.

Figure 7B:
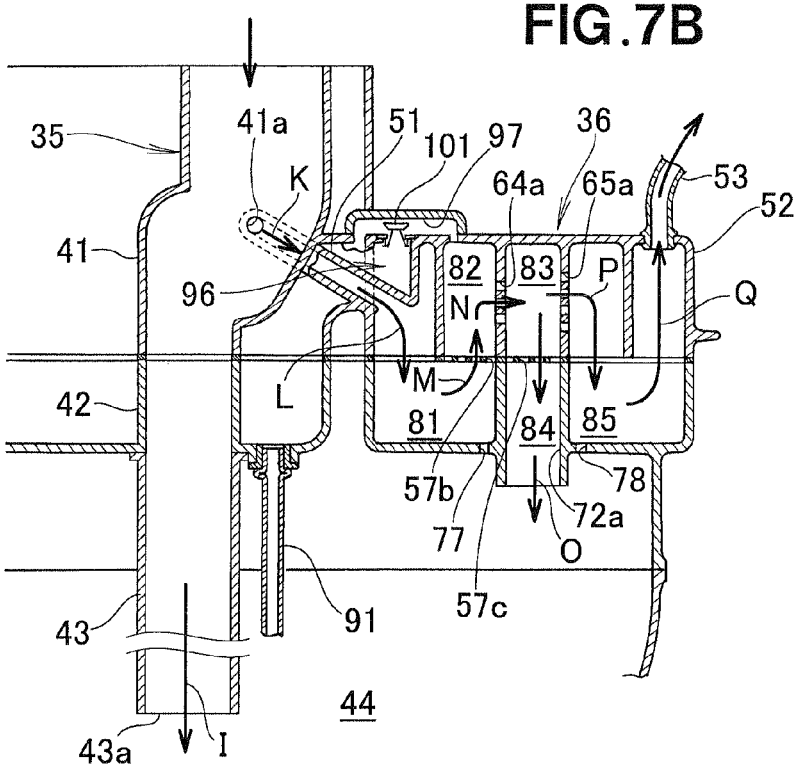

As depicted in FIG. 7B, the value of the water pressure in the cooling water supplying path 91 (cooing water communicating path 96) reaches the threshold value Pt and the relief valve 101 is maintained in its open state. Due to the opening of the relief valve 101, the portion of the cooling water is guided to the idling chamber 52 (second partition chamber 82) through the idling communicating path 97.

On the other hand, the rest of the cooling water (most of the cooling water) is guided to the water jacket of the engine 23 (FIG. 7A) through the cooling water communicating path 96.

As depicted in FIG. 7A, during the high speed rotation of the engine 23, usually, the propeller 27 is rotated as indicated by an arrow and seawater is pushed backward by the propeller 27. In this state, the exhaust gas guided from the exhaust manifold 23*a* is discharged as indicated by an arrow I from the exhaust outlet 43*a* of the exhaust pipe 43 to the exhaust expanding chamber 44. Therefore, the exhaust gas discharged to the exhaust expanding chamber 44 is guided toward the exhaust outlet 44*a* of the exhaust expanding chamber 44 and is discharged as indicated by an arrow J from the exhaust outlet 44*a* into the sea 89.

As depicted in FIG. 7B, the exhaust gas guided from the exhaust manifold 23*a* (FIG. 7A) to the first exhaust path 41 is guided as indicated by an arrow K from the guiding outlet 41*a* of the first exhaust path 41 to the idling exhaust communicating path 51.

The exhaust gas guided is guided as indicated by an arrow L to the first partition chamber 81 of the idling chamber 52 through the idling exhaust communicating path 51. The exhaust gas guided to the first partition chamber 81 is guided as indicated by an arrow M to the second partition chamber 82 through the plurality of first punched holes 57*b*. The exhaust gas guided to the second partition chamber 82 is guided as indicated by an arrow N to the third partition chamber 83 through the plurality of first slits 64*a*.

As above, the exhaust gas guided to the exhaust expanding chamber 44 is discharged as indicated by an arrow J (FIG. 7A) from the exhaust outlet 44*a* of the exhaust expanding chamber 44 into the sea 89. By discharging the exhaust gas in the exhaust expanding chamber 44 into the sea 89 from the exhaust outlet 44*a* in this manner, a portion of the exhaust gas guided to the third partition chamber 83 is guided as indicated by an arrow O to the exhaust expanding chamber 44 through the plurality of second punched holes 57*c* and the fourth partition chamber 84.

On the other hand, the rest of the exhaust gas guided to the third partition chamber 83 is guided as indicated by an arrow P to the fifth partition chamber 85 through the plurality of second slits 65*a*. The exhaust gas guided to the fifth partition chamber 85 is guided as indicated by an arrow Q to the open-to-atmosphere path 53 through the fifth partition chamber 85. The exhaust gas guided to the open-to-atmosphere path 53 is discharged to the atmosphere 88 from the exhaust outlet 53*b* (FIG. 7A) of the open-to-atmosphere path 53.

Figure 8A:
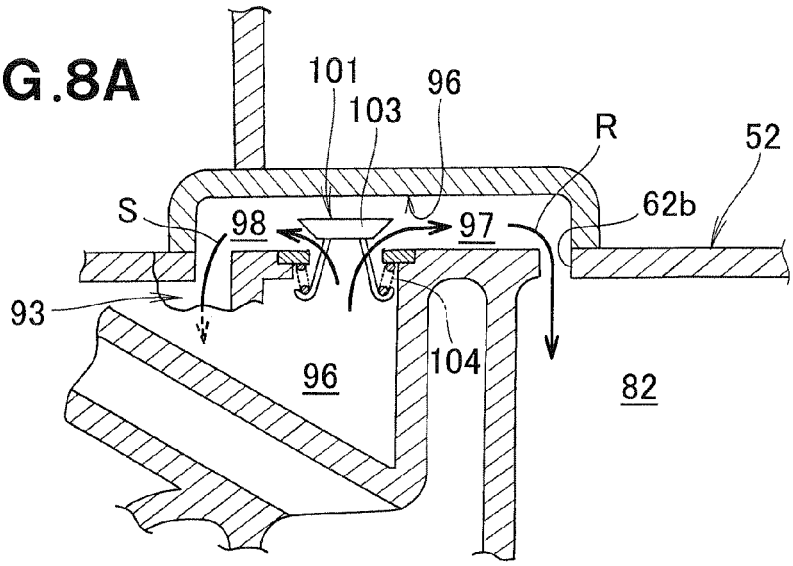
FIGS. 8A and 8B are diagrammatical view illustrating an example of cooling of the idling chamber when the engine is rotated at the high speed.

As depicted in FIG. 8A, the value of the water pressure in the cooling water communicating path 96 reaches the threshold value Pt and the relief valve 101 is maintained in its open state. By maintaining the relief valve 101 in its open state, the portion of the cooling water is guided as indicated by an arrow R to the idling chamber 52 (second partition chamber 82) through the idling communicating path 97.

In the above, it can be considered that the amount of the cooling water that flows through the relief valve 101 exceeds the amount of the cooling water that suitably cools the idling chamber 52 when the relief valve 101 is opened. In such a case, the cooling water that is necessary for cooling the idling chamber 52 is guided to the idling communicating path 97, and the rest of the cooling water is guided to the cooling water discharging path 93 through the water-discharge communicating path 98. Therefore, the portion (a suitable amount) of the cooling water can be guided to the idling chamber 52 (second partition chamber 82) through the idling communicating path 97 and, thereby, the idling chamber 52 can suitably be cooled.

Figure 8B:
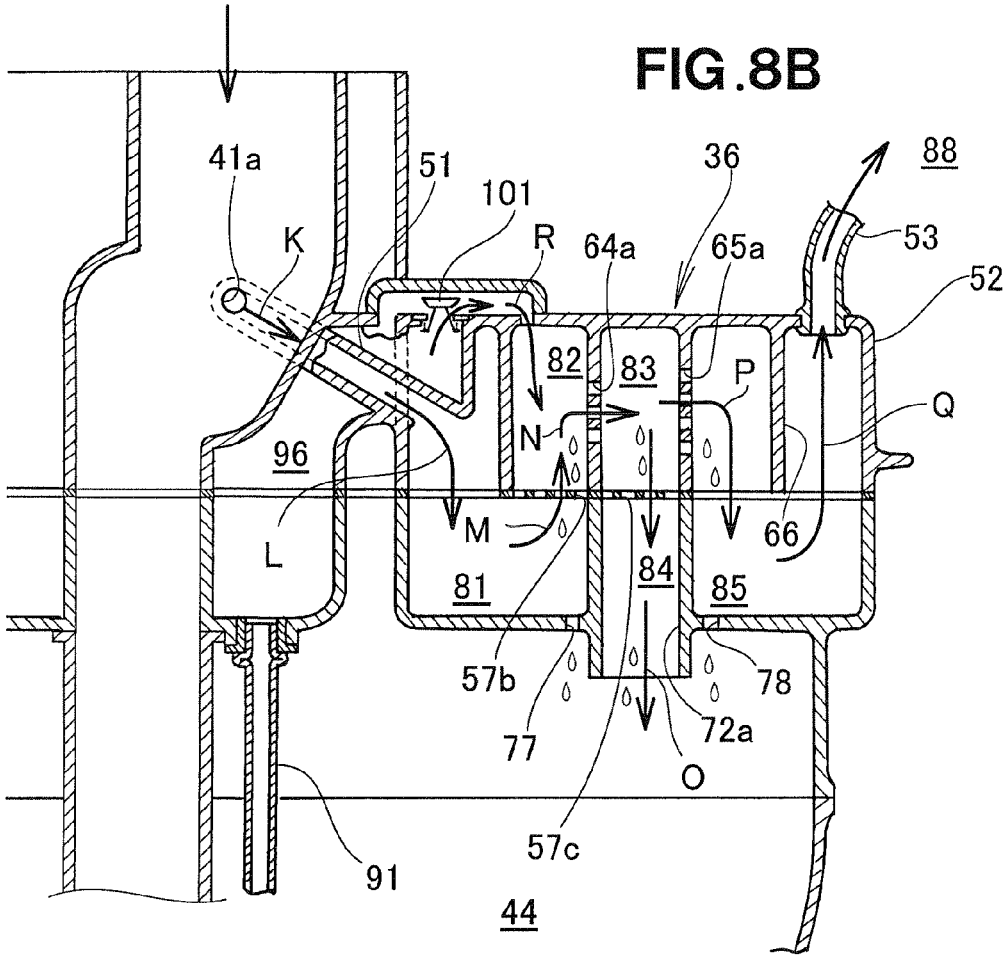

As depicted in FIG. 8B, the cooling water guided to the second partition chamber 82 of the idling chamber 52 is guided with the exhaust gas as indicated by an arrow N to the third partition chamber 83 through the plurality of first slits 64*a*.

The flow speed of the exhaust gas guided as indicated by the arrow N from the second partition chamber 82 to the third partition chamber 83 is slowed by its passing through the plurality of first punched holes 57*b* and the plurality of first slits 64*a*. Thereby, a portion of the cooling water guided to the second partition chamber 82 is separated from the exhaust gas. The separated cooling water is discharged from the first drain hole 77 of the first partition chamber 81 to the exterior of the idling chamber 52 through the plurality of first punched holes 57*b*.

The flow speed of the exhaust gas guided with the cooling water to the third partition chamber 83 is further slowed by its passing through the plurality of second slits 65*a* and the plurality of second punched holes 57*c*. Therefore, the portion of the cooling water guided to the third partition chamber 83 is separated from the exhaust gas. The cooling water separated is discharged from the opening 72*a* of the fourth partition chamber 84 to the exterior of the idling chamber 52 through the plurality of second punched holes 57*c*.

The flow speed of the exhaust gas guided with the cooling water to the fifth partition chamber 85 is further slowed by being guided in a substantially U-shaped route in the fourth partition chamber 66. Therefore, the portion of the cooling water guided to the fifth partition chamber 85 is separated from the exhaust gas. The cooling water separated is discharged from a second drain hole 78 to the exterior of the idling chamber 52.

As above, the cooling water guided to the second partition chamber 82 of the idling chamber 52 can be guided with the exhaust gas to the second, the third, and the fifth partition chambers 82, 83, and 85. In addition, the cooling water guided to the second, the third, and the fifth partition chambers 82, 83, and 85 is discharged from the first drain hole 77, the opening 72*a*, and the second drain hole 78. The first drain hole 77 is formed in the bottom portion of the first partition chamber 81. The opening 72*a* is formed in the bottom portion of the fourth partition chamber 84. The second drain hole 78 is formed in the bottom portion of the fifth partition chamber 85.

As above, the cooling water guided to the second partition chamber 82 of the idling chamber 52 is guided to the first to the fifth partition chambers 81 to 85. Thereby, the entire idling chamber 52 is cooled using the cooling water and, thereby, overheating of the idling chamber 52 can be suppressed.

The relief valve 101 is adapted to be opened by the water pressure of the cooling water when the engine 23 is rotated at a high speed. Therefore, the relief valve 101 is adapted to be opened to guide the portion of the cooling water to the idling chamber 52 to cool the idling chamber 52 when the relatively large amount of exhaust gas flows into the idling chamber 52. Thereby, overheating of the idling chamber 52 by a relatively large amount of the exhaust gas can be suppressed.

The cooling water guided to the second partition chamber 82 is separated from the exhaust gas and is discharged from the first drain hole 77, the opening 72*a*, and the second drain hole 78. Therefore, the exhaust gas guided from the fifth partition chamber 85 to the open-to-atmosphere path 53 includes substantially no cooling water. In this manner, the exhaust gas including substantially no cooling water is discharged from the exhaust outlet 53*b* of the open-to-atmosphere path 53 to the atmosphere 88.

As above, by forming the idling chamber 52 into the labyrinth structure, the cooling water guided to the idling chamber 52 can be separated from the exhaust gas. Thereby, only the exhaust gas can be discharged to the atmosphere 88 without discharging the cooling water to the atmosphere 88 (FIG. 1). Therefore, the merchantability can be secured.

In addition, the first exhaust path 41 is adapted to be open to the atmosphere 88 through the idling chamber 52 at the halfway point (guiding outlet 41*a*) of the first exhaust path 41. Thereby, occurrence of any negative pressure can be suppressed in the exhaust means 35 (exhaust system), for example, when the engine is started up or when the exhaust pulsates.

The outboard engine 10 according to the present invention is not limited to the above embodiment and can properly be changed, improved, etc. For example, in the embodiment, the example has been described where the cooling water communicating path 96 is branched downstream the relief valve 101 into the idling communicating path 97 and the water-discharge communicating path 98. However, the branching is not limited to the above and the cooling water communicating path 96 does not need to be branched downstream the relief valve 101 and only the idling communicating path 97 may be present.

In the embodiment, the example has been described where the value of the water pressure of the cooling water reaches the threshold value Pt when the speed of the rotation of the engine 23 reaches the high speed of 5,000 rpm. However, the variation of the water pressure is not limited to the above according to the present invention, and the value of the water pressure may be set to reach the threshold value Pt when the speed of the rotation of the engine 23 reaches a high speed other than 5,000 rpm.

The shape and the configuration of each of such components that are described in the embodiment are not limited to those that are exemplified above and are properly be changeable, as the outboard engine 10, the engine 23, the first and the second exhaust paths 41 and 42, the exhaust pipe 43, the idling chamber 52, the upper and the lower chamber units 55 and 56, the metal gasket 57, the first opening 57*a*, the first and the second punched holes 57*b* and 57*c*, the second opening 57*d*, the first to the fourth upper partition walls 63 to 66, the first and the second lower partition walls 73 and 74, the cooling water supplying path 91, the water pump 92, the cooling water communicating path 96, and the relief valve 101.

The present invention is suitably used for an outboard engine that includes a cooling water path to suck up seawater or freshwater as cooling water and an exhaust path to discharge exhaust gas of the engine into the exterior.

Obviously, various minor changes and modifications of the present invention are possible in light of the above teaching. It is therefore to be understood that within the scope of the appended claims the invention may be practiced otherwise than as specifically described.

What is claimed is:

1. An outboard engine designed to draw cooling water through a cooling water path by rotating a water pump by means of an engine and to discharge exhaust gas of the engine to an exterior through exhaust paths, comprising:

an idling chamber communicating with the exhaust paths and opening to an atmosphere, the exhaust paths in communication with an exhaust expanding chamber;

a cooling water communicating path causing the cooling water path to communicate with the idling chamber; and a pressure adjusting valve provided for the cooling water communicating path, the pressure adjusting valve opening the cooling water communicating path when a value of a water pressure in the cooling water path reaches a threshold value, wherein a portion of the cooling water is guided to the idling chamber through the cooling water communicating path by opening the pressure adjusting valve when the value of the water pressure in the cooling water path reaches the threshold value, and wherein when the pressure adjusting valve is closed, the exhaust expanding chamber is adapted to discharge exhaust gas to the idling chamber.

2. The outboard engine of claim 1, wherein the pressure adjusting valve is opened by the water pressure of the cooling water when the engine is rotated at a high speed.

3. The outboard engine of claim 1, wherein the idling chamber is formed into a labyrinth structure that separates the cooling water guided to the idling chamber from the exhaust gas.

4. An outboard engine designed to draw cooling water through a cooling water path by rotating a water pump by means of an engine and to discharge exhaust gas of the engine to an exterior through exhaust paths, comprising:

an idling chamber communicating with the exhaust paths and opening to an atmosphere;

a cooling water communicating path causing the cooling water path to communicate with the idling chamber; and a pressure adjusting valve provided for the cooling water communicating path, the pressure adjusting valve opening the cooling water communicating path when a value of a water pressure in the cooling water path reaches a threshold value, wherein a portion of the cooling water is guided to the idling chamber through the cooling water communicating path by opening the pressure adjusting valve when the value of the water pressure in the cooling water path reaches the threshold value, and wherein the idling chamber is formed into a labyrinth structure that separates the cooling water guided to the idling chamber from the exhaust gas and comprises an upper chamber unit, a lower chamber unit, and a sealing material sandwiched by the upper and the lower chamber units, and wherein the labyrinth structure is configured by upper partition walls provided for the upper chamber unit, lower partition walls provided for the lower chamber unit, and openings formed in the sealing material.

5. The outboard engine of claim 1, wherein when the pressure adjusting valve is open, the exhaust expanding chamber is adapted to receive exhaust gas from the idling chamber.

* * * * *